US005669793A

United States Patent [19]

Walton

[11] Patent Number: 5,669,793

[45] Date of Patent: Sep. 23, 1997

[54] APPARATUS AND METHOD FOR PROPELLING A WATER VEHICLE

[76] Inventor: William H. Walton, 32 Sun Valley Ct., Alexnder, N.C. 28701

[21] Appl. No.: 444,439

[22] Filed: May 19, 1995

Related U.S. Application Data

[63] Continuation-in-part of Ser. No. 265,024, Jun. 24, 1994, abandoned.

[51] Int. Cl.[6] ..... B63H 16/02

[52] U.S. Cl. ..... 440/25; 440/19

[58] Field of Search ..... 440/90–97, 27, 440/26, 25, 101–103, 19; 416/117, 139, 144

[56] References Cited

U.S. PATENT DOCUMENTS

| | | | |
|---|---|---|---|
| 2,599,791 | 6/1952 | Swenson | 440/18 |
| 2,980,054 | 4/1961 | Sanders | 440/92 |
| 5,090,928 | 2/1992 | Rybczyk | 440/24 |
| 5,194,023 | 3/1993 | Stone | 440/25 |
| 5,213,528 | 5/1993 | Seiford, Sr. | 440/90 |

FOREIGN PATENT DOCUMENTS

| | | | |
|---|---|---|---|
| 2602738 | 2/1988 | France | 440/24 |

*Primary Examiner*—Jesus D. Sotelo
*Attorney, Agent, or Firm*—Carter & Schnedler

[57] ABSTRACT

There is provided an apparatus for propelling a water vehicle. A plurality of rotatable paddles are mounted on a pair of spaced apart slidable slide mechanism. The slide mechanism are moveable within a pair of channels formed on opposing sides of a frame. The slide mechanisms are connected to rowing handles and/or foot pedals for providing power. The paddles are rotated down during the power stroke and are rotated up while returning to the initial position. The apparatus may be used to retro-fit an existing water vehicle or may be an integral part of a water vehicle.

4 Claims, 14 Drawing Sheets

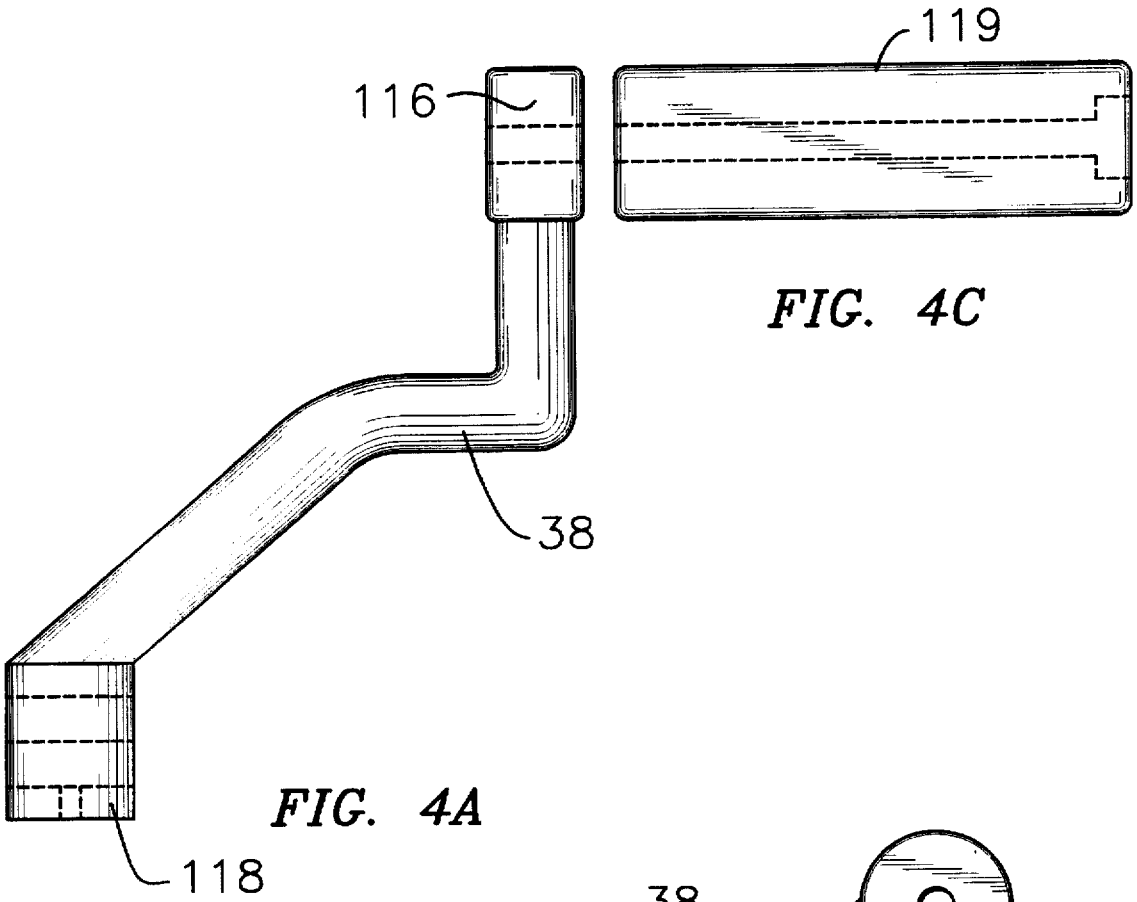
FIG. 4C
FIG. 4A
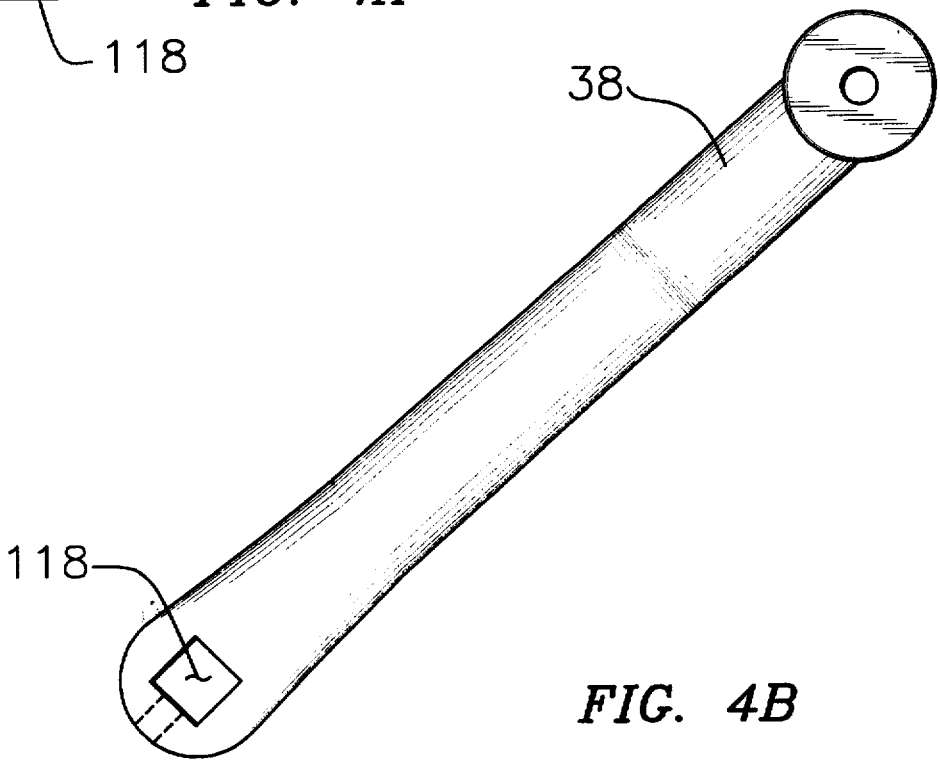
FIG. 4B

APPARATUS AND METHOD FOR PROPELLING A WATER VEHICLE

RELATED APPLICATION

This is a continuation-in-part of U.S. Application Ser. No. 08/265,024 filed on Jun. 24, 1994 by William H. Walton, titled "POWER PADDLE SYSTEM OR WATER BUG PONTOON POWER PADDLE SYSTEM", now abandoned.

BACKGROUND OF THE INVENTION

This invention relates to water vehicles. More particularly, it relates to an apparatus for providing power for water borne vehicles.

In general, the evolution of row boats has been determined by the most economic use of materials at hand. The rowing stroke required to propel or steer a floating vehicle, such as a typical rowboat, was to develop pivot points on which a pair of oars could rest. Once this was accomplished, the operator would face to the rear of the boat, lift the oars out of the water, then deposit the flat surfaces of the oars into the water. The arms and braced legs would exert force to pull the oar blades back. Water pressure against the oar surfaces would create forward movement of the boat. This could only be accomplished if the rowing oars were maintained in position by oar locks. Conventional rowing was limited to energy exerted by upper body through arm movement and by lower body movement through the braced leverage of the legs.

Another method of achieving similar forward motion of a floating vessel is the paddling technique, wherein the paddler faces forward and no pivot point is required to obtain the results, e.g., a canoe and paddle. The energy developed by the use of a canoe paddle comes only from upper body strength and is not effective in other vessel designs. In addition, safety and carrying weight are limited.

Both the rowing and paddling techniques are based on economics, materials and technology available.

Another technique of manually propelling a small craft is the so-called pedal or paddle boat. The pedal boat essentially utilizes a bicycle crank which engages a paddle wheel or propeller through a series of mechanical linkages. The typical pedal boat does not utilize upper arm strength in propelling the boat.

U.S. Pat. No. 5,090,928 issued to Rybczyk shows various devices utilizing leg power to propel a boat or a swimmer. U.S. Pat. No. 5,194,023 issued to Stone shows a water craft which is propelled by an individual utilizing cross-country skiing action. It is not believed that the devices shown in the Rybczyk or Stone patent have met with commercial success.

OBJECTS OF THE INVENTION

It is therefore one object of this invention to provide an improved apparatus for propelling water vehicles.

It is another object of this invention to provide an apparatus which will efficiently propel water vehicles using manual power.

It is yet another object of this invention to provide an apparatus which will propel water vehicles utilizing both the upper and the lower body strength of the operator.

It is further another object of this invention to provide an apparatus for propelling water vehicles which enables the operator to face in the forward direction while utilizing a rowing motion.

It is another object of this invention to provide a manual propulsion system for water vehicles which efficiently utilizes leverage.

It is yet another object of this invention to provide a water vehicle propulsion system for water vehicles which may be retro-fitted to existing water craft.

It is still yet another object of this invention to provide a water vehicle which will operate quietly.

SUMMARY OF THE INVENTION

In accordance with one form of this invention there is provided an apparatus for propelling a water vehicle including a frame. At least one paddle mounted on a slidable slide mechanism. The slide mechanism is moveable within a channel. The paddle is rotatable so that the paddle extends downwardly into the water when the slidable slide mechanism moves in one direction during the power stroke and is raised when the slide mechanism moves in the opposite direction to be reset. The slide mechanism is connected to a driving mechanism, such as arm handles and/or foot pedals which transfers the power from the operator to the apparatus.

In accordance with another form of this invention, there is provided an elongated paddle having first and second ends. A pivot mechanism is provided near the first end. The pivot mechanism enables the paddle to rotate to lowered and raised positions. Portions of the second end of the paddle are more dense than portions of the first end so that the paddle will automatically drop to the lowered position. Preferably, one of the surfaces of the paddle is convexed for improved hydrodynamics.

In accordance with yet another form of this invention, there is provided a method for propelling a water vehicle. The operator of the water vehicle faces the forward direction, i.e., the direction in which the vehicle will travel. The operator grasps a pair of moveable handles which are attached to the vehicle and moves the handles in the direction of the operator's body simulating rowing action, thereby propelling the vehicle in the forward direction.

BRIEF DESCRIPTION OF THE DRAWINGS

The subject matter which is regarded as the invention as set forth in the appended claims, the invention itself, however together with further objects and advantages thereof, may be better understood with reference to the following description, taken in conjunction with the accompanying drawings, in which:

FIG. 4A is a side elevational view showing a rowing handle arm which may be utilized with the apparatus of FIG. 2;.

FIG. 4B is a top view of the apparatus of FIG. 4A; FIG. 4C is a view of a typical handle for attachment to the handle arm of FIGS. 4A and 4B;

DESCRIPTION OF THE PREFERRED EMBODIMENTS

Figure 2:
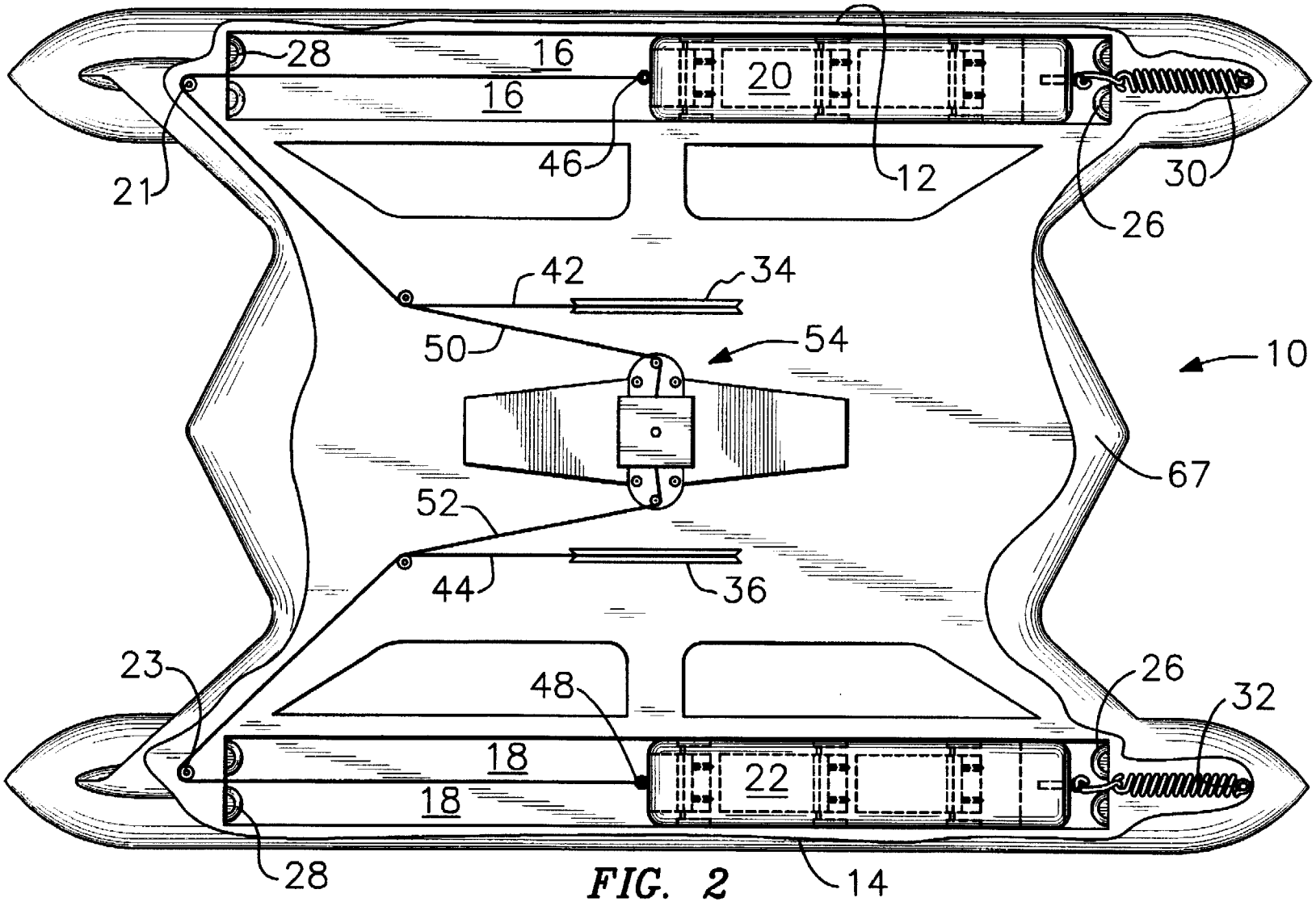
FIG. 2 is a top view showing the apparatus of the subject invention including the frame structure.

Referring now more particularly to FIG. 2, there is provided frame 10 including a pair of slide assemblies 12 and 14. Slide assemblies 12 and 14 each include cavities 16 and 18 which guide substrates or slides 20 and 22. Preferably, cavities 16 and 18 are approximately twice the length of slides 20 and 22.

Figure 5:
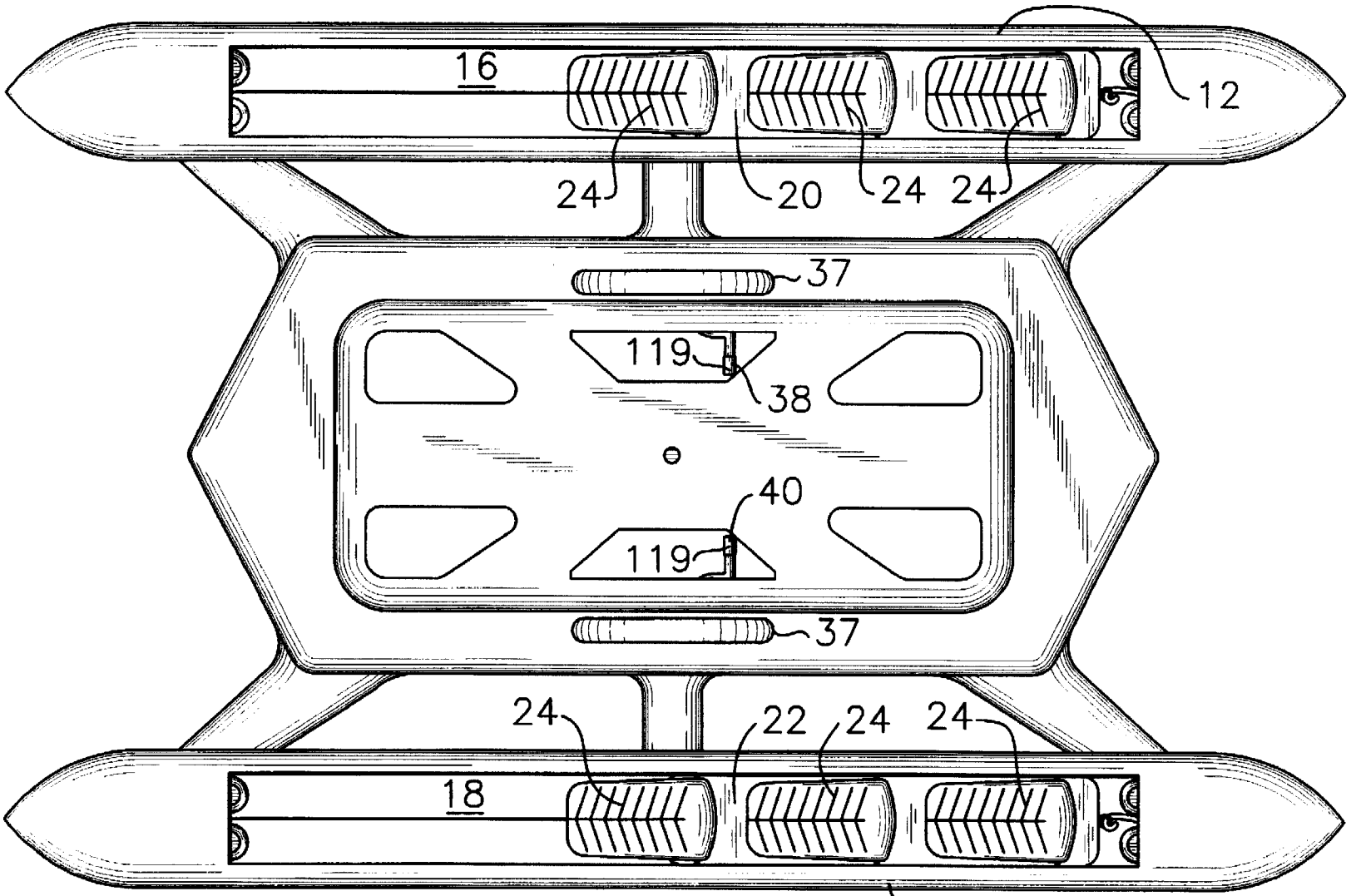
FIG. 5 is a bottom view of the apparatus of FIG. 2 with paddles in a raised position.

Referring now more particularly to FIG. 5, each slide assembly includes a plurality of rotatable paddles 24 attached to the bottom thereof. The paddles will be discussed in more detail below.

Referring again to FIG. 2, each cavity 16 and 18 includes a pair of rubber bumpers 26 at one end of each channel 16 and 18 and a pair of rubber bumpers 28 at the other end of each channel.

A pair of springs 30 and 32 are connected to slides 20 and 22 for holding the slides in the position shown in FIG. 2 during the rest condition. Approximately 10% of the force available from springs 30 and 32 are applied to slides 20 and 22 in the rest position, as shown in FIG. 2, so as to hold the slides in the forward part of the cavities. When the slides 20 and 22 have travelled to the rear of each cavity, thereby making contact with rubber bumpers 28, the spring will stretch to the extent that it applies 90% of it spring tension for return to the forward part of the cavity.

A pair of spring loaded flywheels 34 and 36 are rotatably mounted to frame 10 by brackets (not shown). As can be seen in reference to FIG. 6, a pair of handle arms 38 and 40 are respectively connected to the flywheels 34 and 36. The are adapted to be grasped by the user of the apparatus and pulled toward the user's body so as to impart upper body forces by a rowing motion to propel the water vehicle. The setup shown in FIG. 6 is such that the user is facing in the forward direction with respect to the normal movement of the water vehicle.

Referring again to FIG. 2, a pair of elongated cables 42 and 44 are connected to flywheels 34 and 36 and are, in turn, connected to eyelets 46 and 48 which are attached to slides 20 and 22. A second pair of cables 50 and 52 are connected to eyelets 46 and 48 and to the foot operated portion of the apparatus, wherein generally indicated as item 54. Cables 42 and 50 pass around reversing roller 21 and cables 44 and 52 pass around reversing roller 23.

Figure 6:
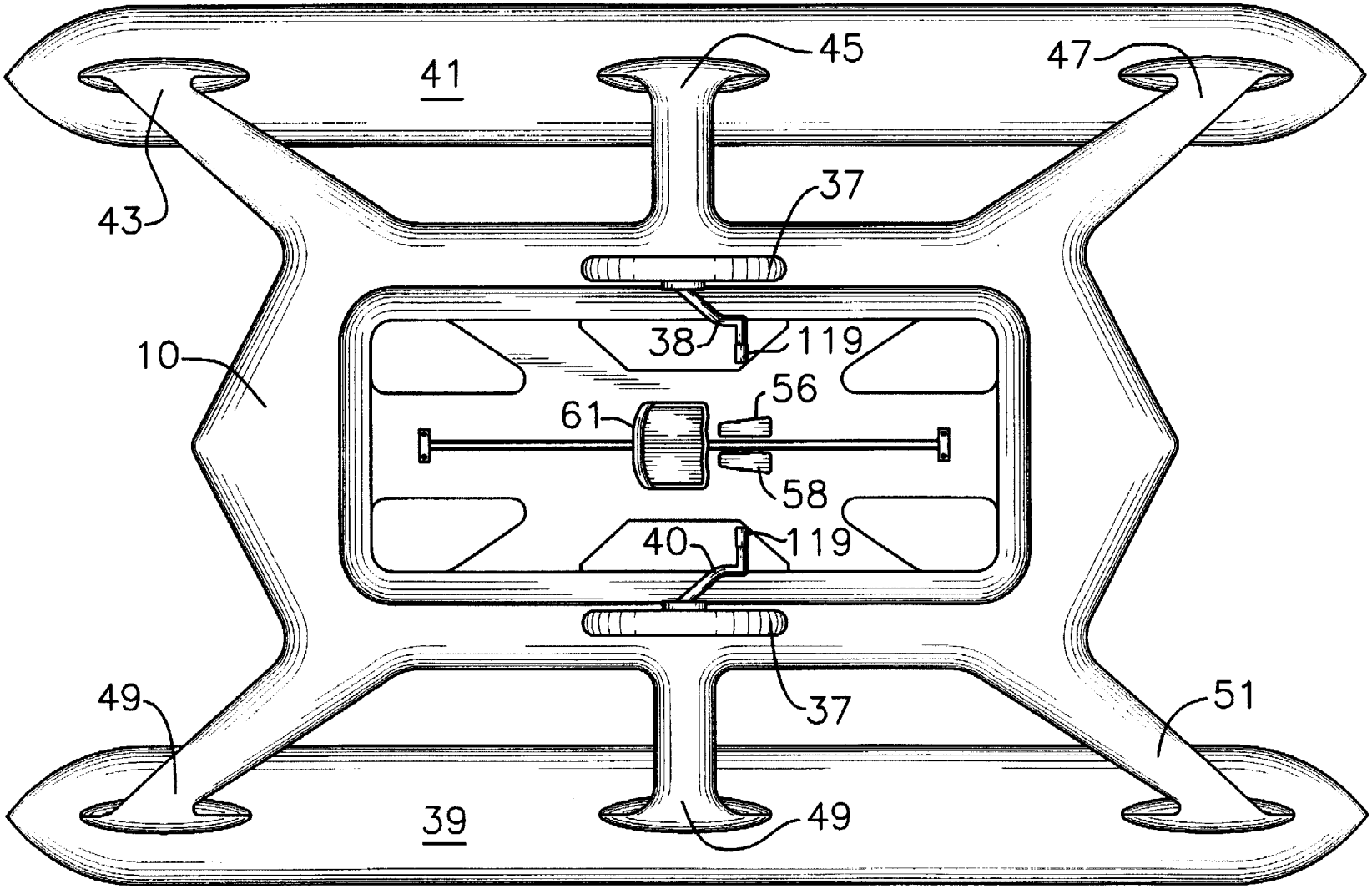
FIG. 6 is a top view of a complete water vehicle of the subject invention including the frame and pontoons.

As shown in FIG. 6, a pair of foot pedals 56 and 58 are mounted in front of seat 61. The foot pedals impart lower body forces for providing additional power for the apparatus.

Figure 3A:
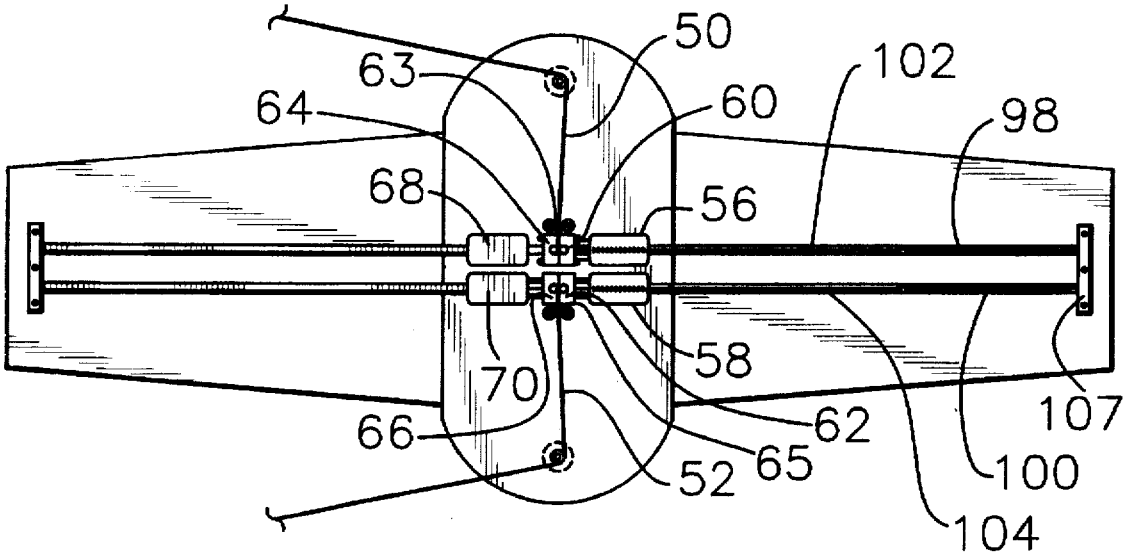
FIG. 3A is a top view showing in more detail the foot pedal drive portion of the apparatus of FIG. 2.

Referring now to FIG. 3A, foot pedals 56 and 58 are connected to slide block assemblies 60 and 62. Cable 50 is connectable to slide block assembly 60, and cable 52 is connectable to slide block assembly 62 through eyelets 63 and 65. When it is desired for the operator to sit facing the rear 67 of the apparatus, by rotating seat 61 by 180°, the cables 50 and 52 will be connected to slide block assemblies 64 and 66 again through eyelets (not shown). Slide block assemblies 64 and 66 are connected to foot pedals 68 and 70.

As previously stated in reference to FIG. 5, a plurality of paddles 24 are connected to each substrate or slide 22. Slides 20 and 22 are identical. Thus for simplification only slide 20 will be described in detail.

Figure 1A:
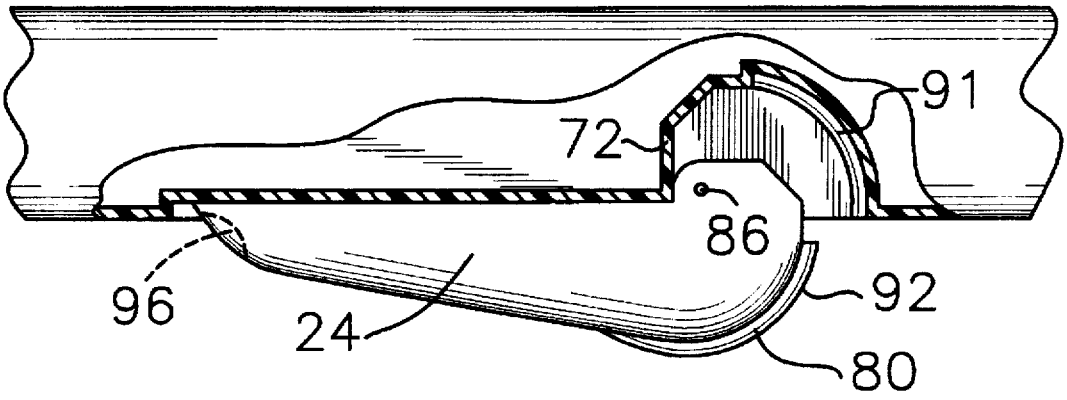
FIG. 1A is a side elevational view of the paddle of the subject invention with the paddle being in the raised position.
Figure 10A:
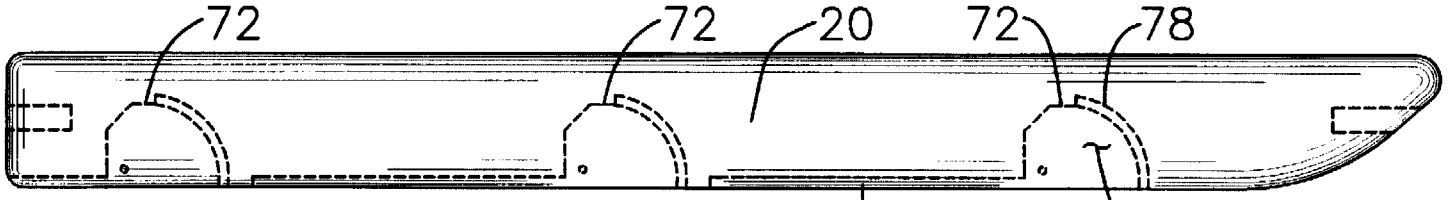
FIG. 10A is a side elevational view showing the slide assembly of the subject invention.
Figure 10B:
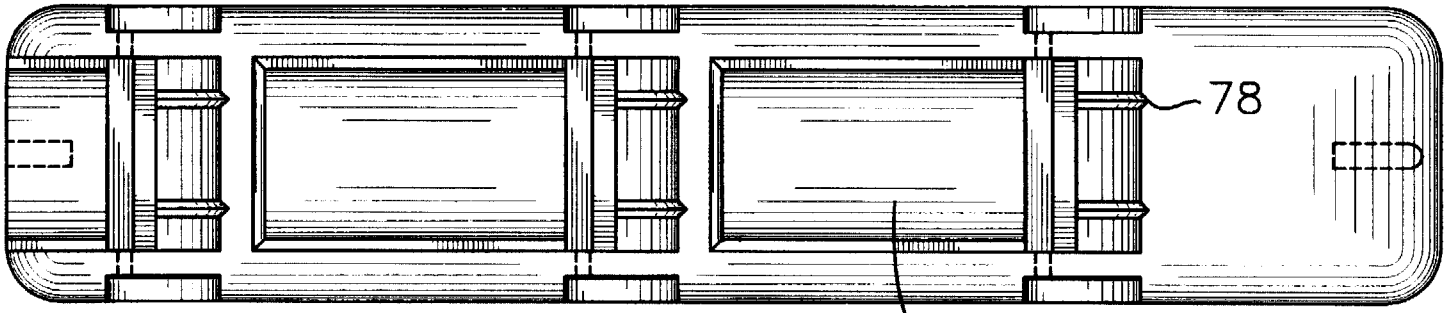
FIG. 10B is a bottom view of the apparatus of FIG. 10A.
Figure 10C:
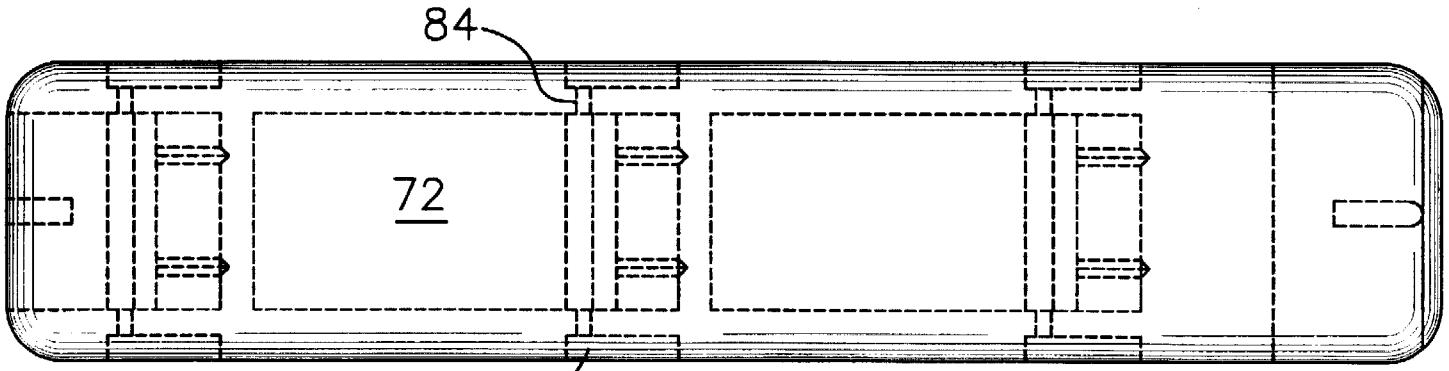
FIG. 10C is a top view of the apparatus of FIG. 10A showing portions thereof in phantom.

Referring now to FIGS. 10A–10C, slide 20 includes three identical cavities 72. The cavities are somewhat L-shaped to conform to the shape of the portion of the paddles 24, shown in FIGS. 1A–1C, to be housed in the cavities when the paddles 24 are in the raised position, as shown in FIGS. 1A. Cavity 72 includes a somewhat rounded section 74 and elongated rectangular section 76. A pair of grooves 78 extend above section 74 for receiving guide ribs 80 which extend from a portion of paddle 24.

Slide 20 includes a plurality of embossments 82 which are adjacent to the enlarged rounded sections 74. Apertures 84 connect the rounded sections 74 with embossments 82.

Figure 1B:
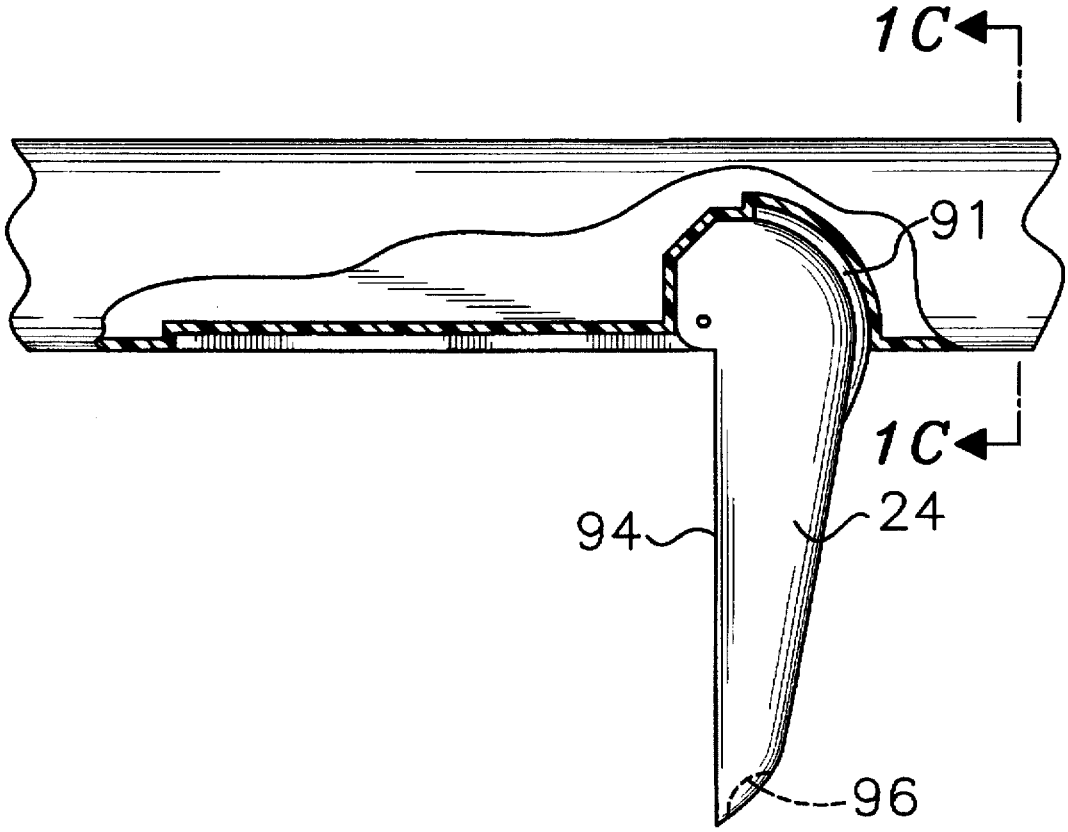
FIG. 1B is a side elevational view of the paddle of the subject invention with the paddle being in the lowered position.
Figure 1C:
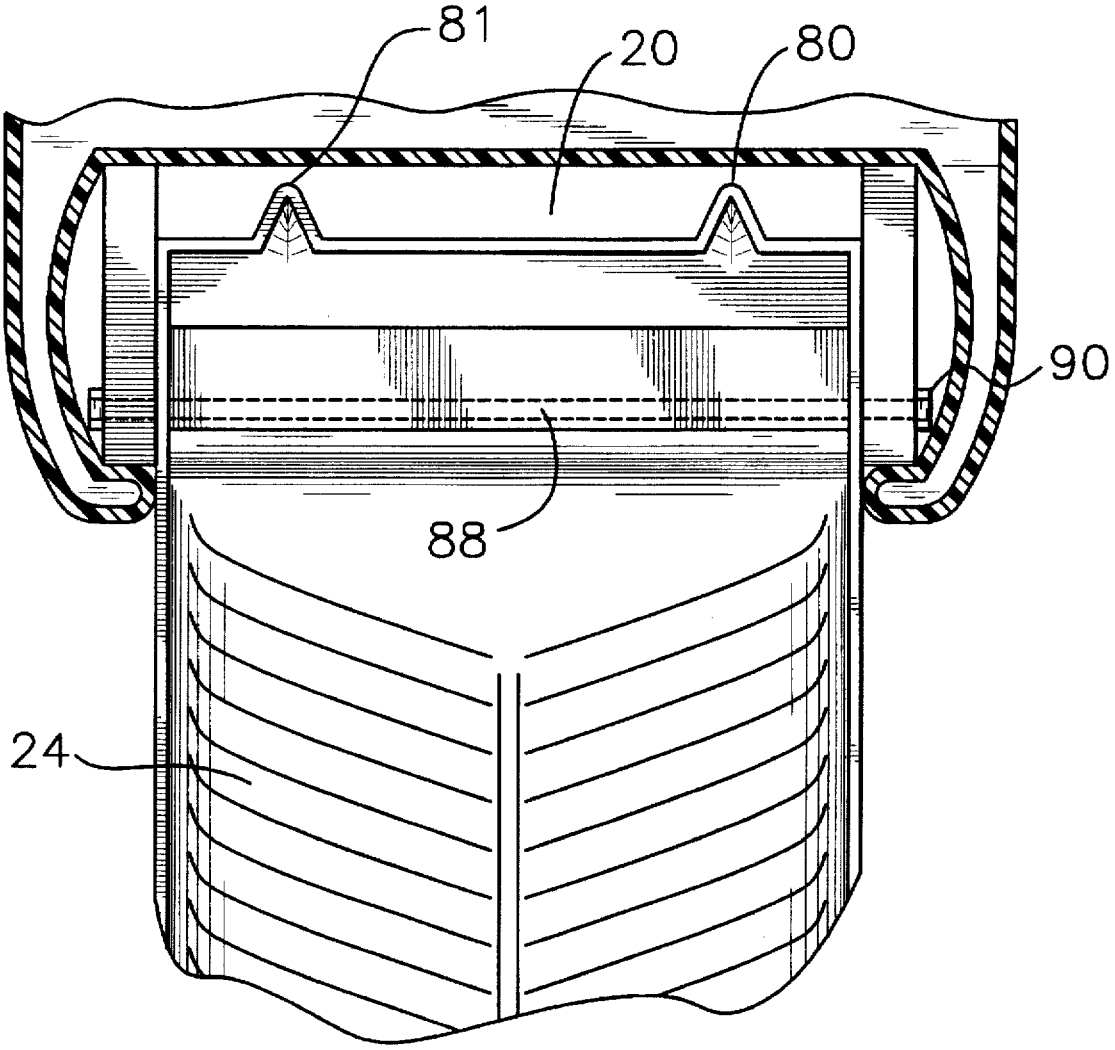
FIG. 1C is a partial front elevational view of the paddle generally on Line 1C—1C of FIG. 1B.

Paddle 24 includes a bore 86 extending therethrough and aligning with apertures 84. A pivot bolt 88 is received through channel 86 and apertures 84 and are secured by nuts 90. The pivot bolt enables the paddle 24 to rotate to the lowered position for the power stroke, as shown in FIG. 1B, and to the raised position, as shown in FIG. 1A, when the slide 20 returns to the initial position while the operator is at rest.

One outer face 92 of paddle 24 is convexed so as to permit water to freely flow there past without undue drag. The opposing face 94 of paddle 24 may be flat, but is preferably concaved to enhance the paddling action. The paddle 24 also includes weighted tip 96 which could be made of lead, and which, by the force of gravity, causes the paddle to drop to its position shown in FIG. 1B prior to the power stroke. Once the force applied by the water on the surface 92 becomes less than the force due to weighted tip, the paddle will drop to its lower position.

Referring now more particularly to FIG. 3A, foot pedals 56 and 58 are connected to springs 98 and 100 through cables 102 and 104. Springs 98 and 100 are connected to mounting bracket 107 which is secured to frame 10. Springs 98 and 100 will maintain tension in cables 50 and 52, that is, they will keep the slack out of the cables when only the rowing handles 38 and 40 are in use and not the pedals 56 and 58. There are identical springs and cable couplings for foot pedals 68 and 70 which are used in lieu of pedals 56 and 58 when the operator uses the apparatus facing the rear 67. In that case, cables 50 and 52 must be connected to slide blocks 64 and 66.

Figure 3B:
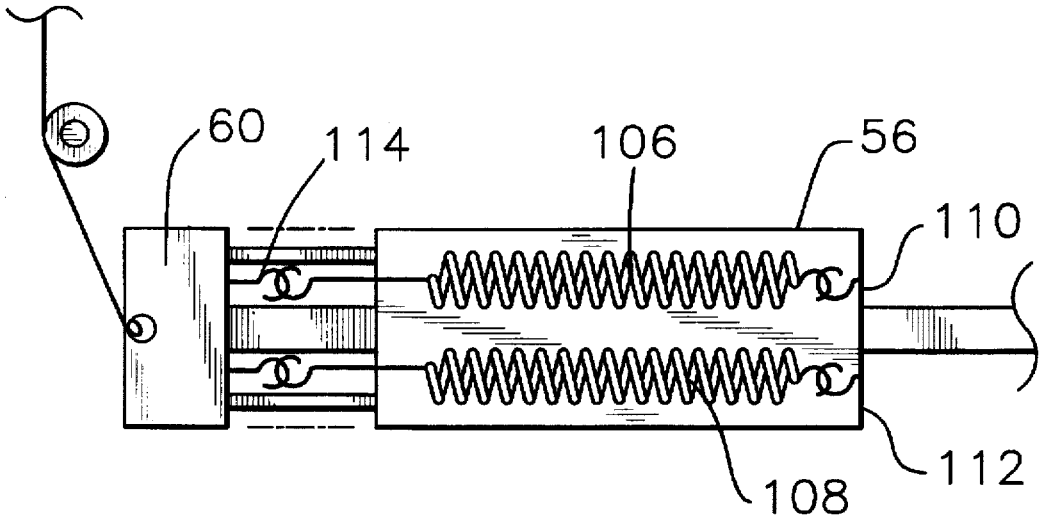
FIG. 3B shows the bottom side of one of the foot pedals shown in FIG. 3A.

Referring now more particularly to FIG. 3B, the foot pedals 56 and 58, as well as the other foot pedals, have a pair of springs 106 and 108 connected on the bottom side thereof. The springs are attached to the front portion 110 of the foot pedal 56 by means of eyelets 112. The other end of the springs are attached to sliding block assembly 60 by eyelets 114.

Figure 11A:
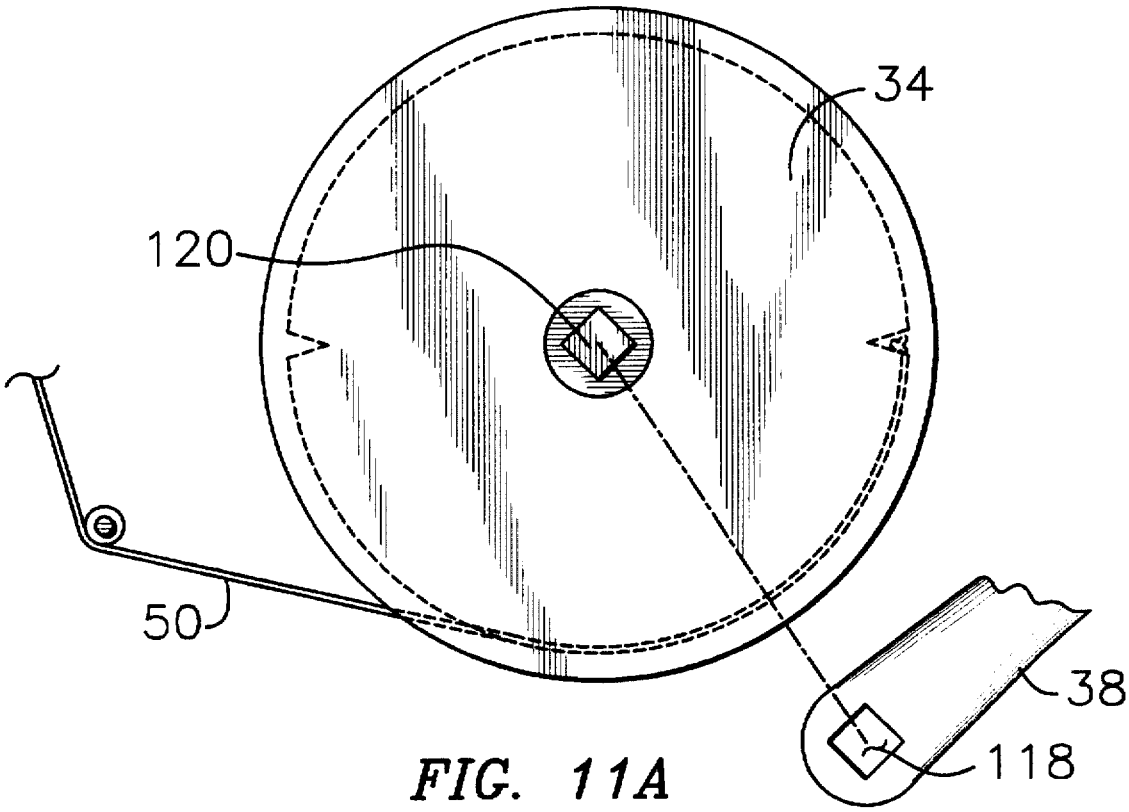
FIG. 11A is a side elevational view showing the flywheel assembly set up for the operator to sit in the forward facing position.
Figure 11B:
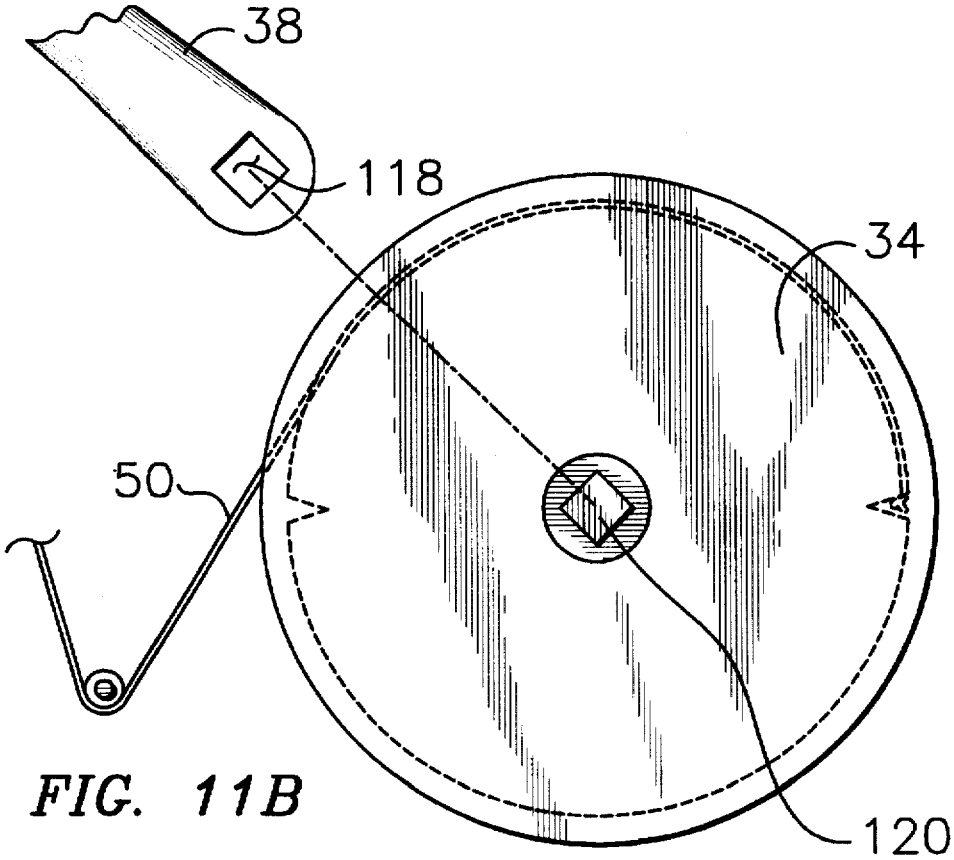
FIG. 11B is a side elevational view showing the flywheel assembly set up for the operator to sit in the rear facing position.

Referring now more particularly to FIGS. 4A and 4B, handle arm 38 include grip connectors 116 and socket connectors 118. Socket connectors 118 are adapted to be connected to studs 120 FIGS. 11A and 11B flywheels 34 and 36. The handle arm may be reversed, as shown in FIGS. 11A and 11B, depending on the position of the operator, i.e., whether the operator is in the forward facing position, as shown in FIG. 11A, or in the rear facing position, as shown in FIG. 11B. If the operator is in the forward facing position, the cable 50 will feed on to the underside of the flywheel 34, as shown in FIG. 11A. However, as shown in FIG. 11B, if the operator has his/her back facing the forward of the apparatus, cable 50 will feed to the top side of the flywheel 34.

Figure 7:
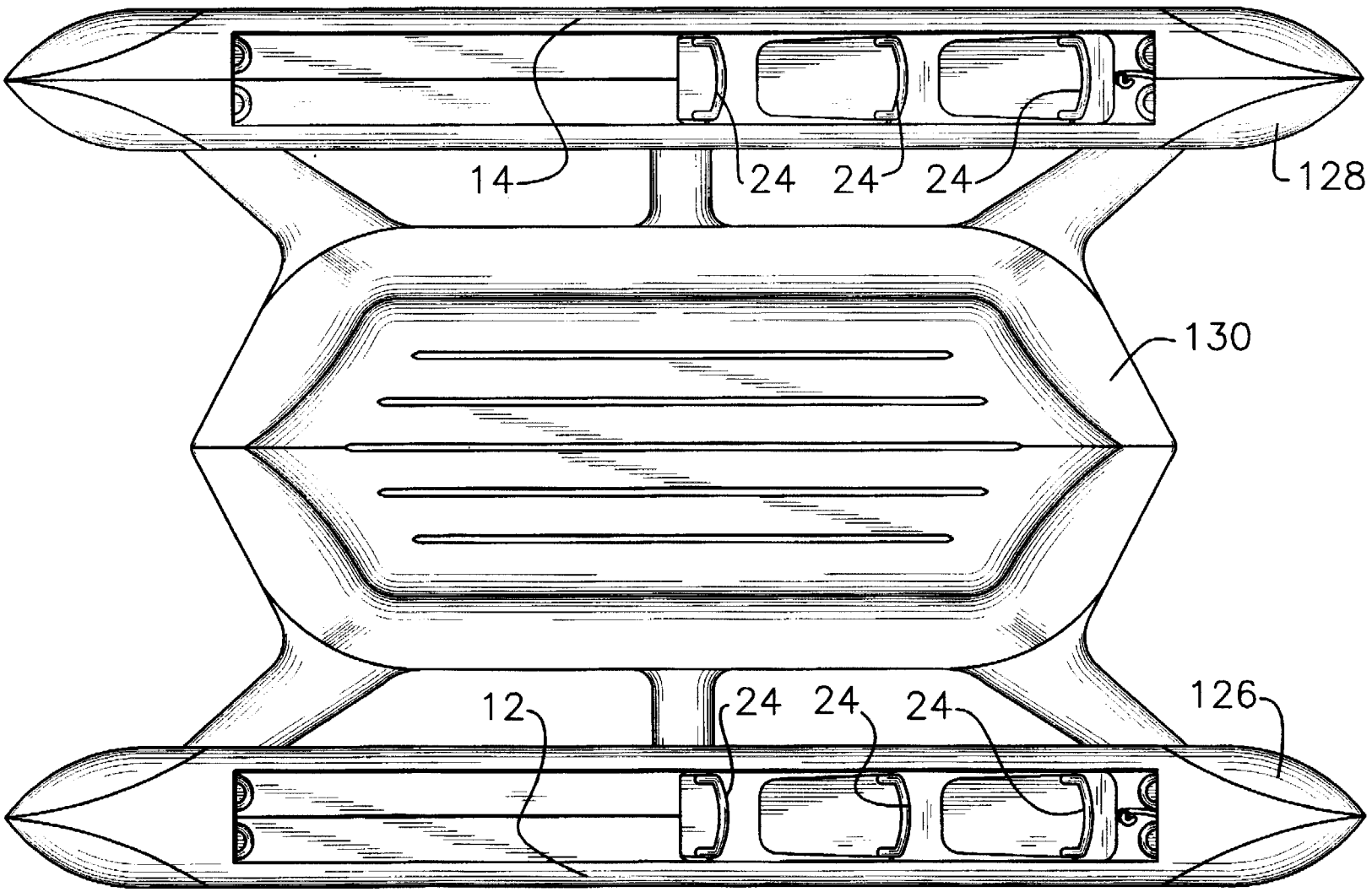
FIG. 7 is a bottom view of the apparatus of FIG. 6.
Figure 12:
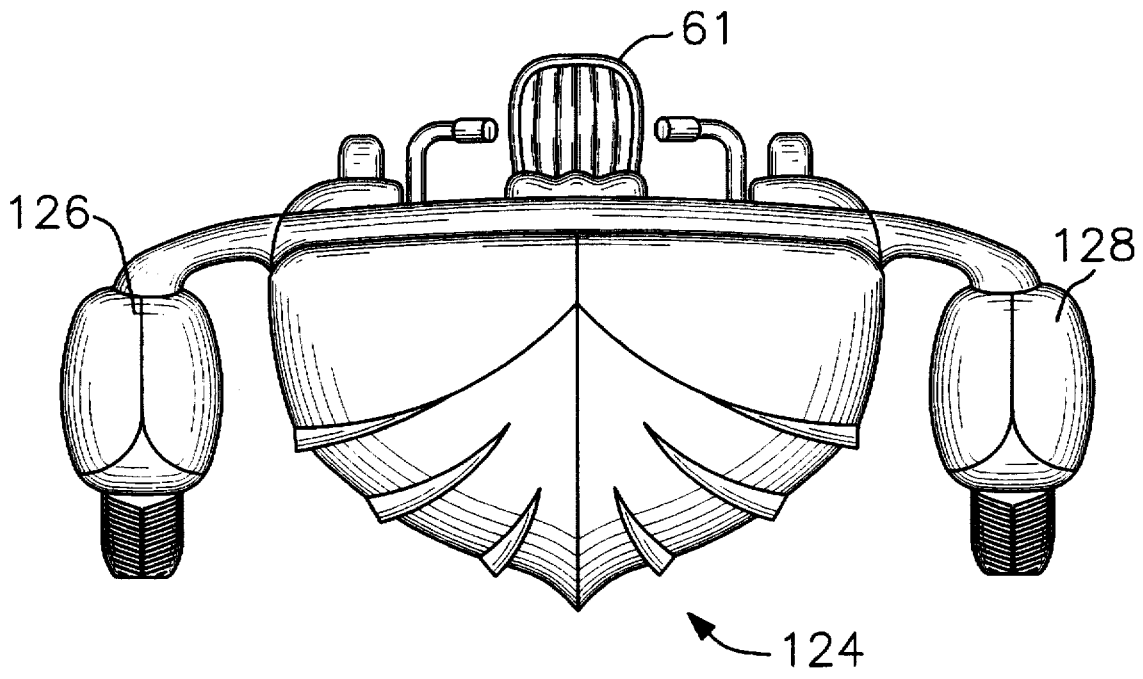
FIG. 12 is a front view of the apparatus of the subject invention combined with a rowboat shaped water vehicle.

FIGS. 7 and 12 show the apparatus as a stand-alone water vehicle, that is, apparatus 124 includes a pair of pontoons 126 and 128 and boat-like structure 130. The slide assemblies 12 and 14 are mounted on the bottom of pontoons 126 and 128, as better seen with reference to FIG. 7.

Figure 13A:
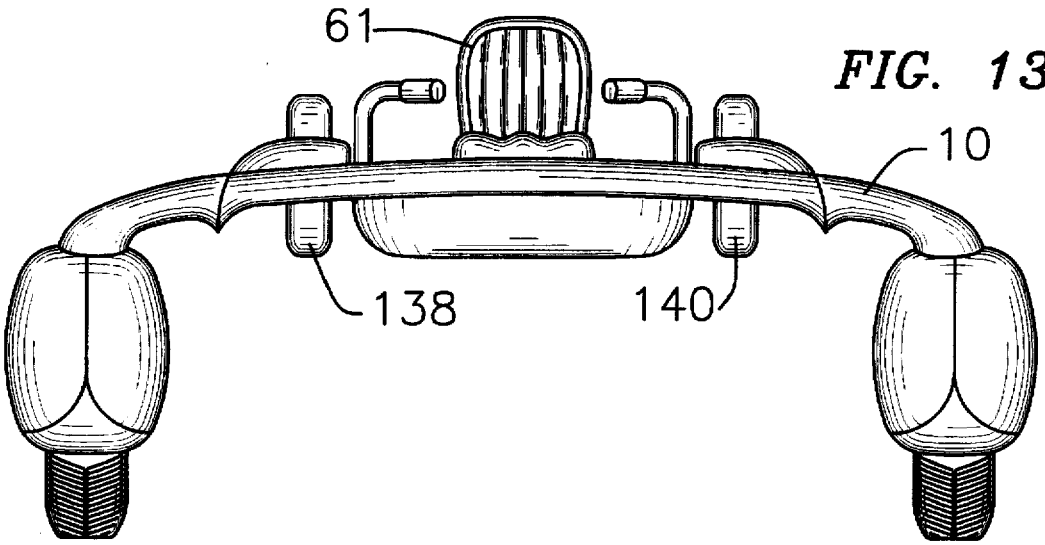
FIG. 13A is a front elevational view showing the apparatus of subject invention combined with pontoons.
Figure 13B:
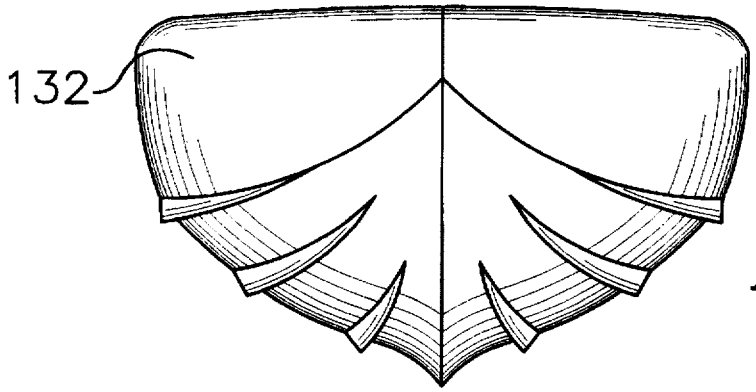
FIG. 13B is a front elevational view of a conventional rowboat upon which the apparatus of the subject invention may be mounted.
Figure 13C:
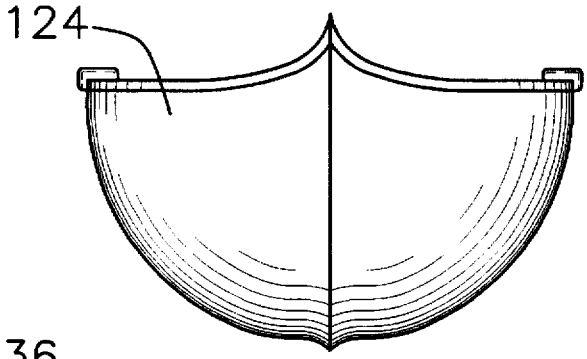
FIG. 13C is a front elevational view of a canoe upon which the apparatus of the subject invention may be mounted.
Figure 13D:
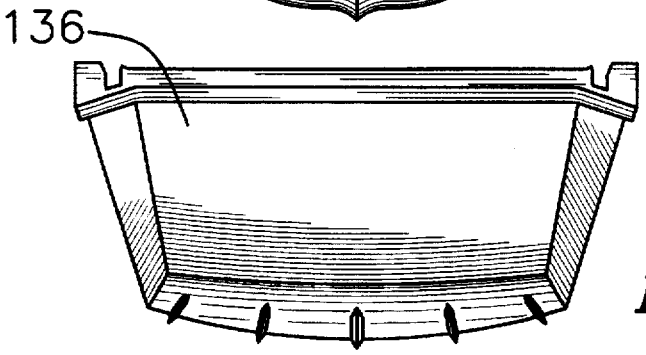
FIG. 13D is a front elevational view of a jon boat upon which the apparatus of the subject invention may be mounted.

FIG. 13A also shows a stand-alone water vehicle, however, with the boat-like structure 130 being omitted. While the apparatus of FIG. 13A is stand-alone, it is preferable to mount the apparatus of FIG. 13A to either a standard conventional style rowboat 132, as shown in FIG. 13B, a canoe 134, as shown in FIG. 13C, or a jon boat 136, as shown in FIG. 13D. In order to accomplish the mounting of the apparatus of FIG. 13A to the above described boats, a simple mounting assembly 138 and 140 is provided on the underside of frame 10. The mounting assembly 138 and 140 is adapted to interface with simple mounting brackets applied to the top side of the conventional rowboat, canoe or jon boat.

Figure 9:
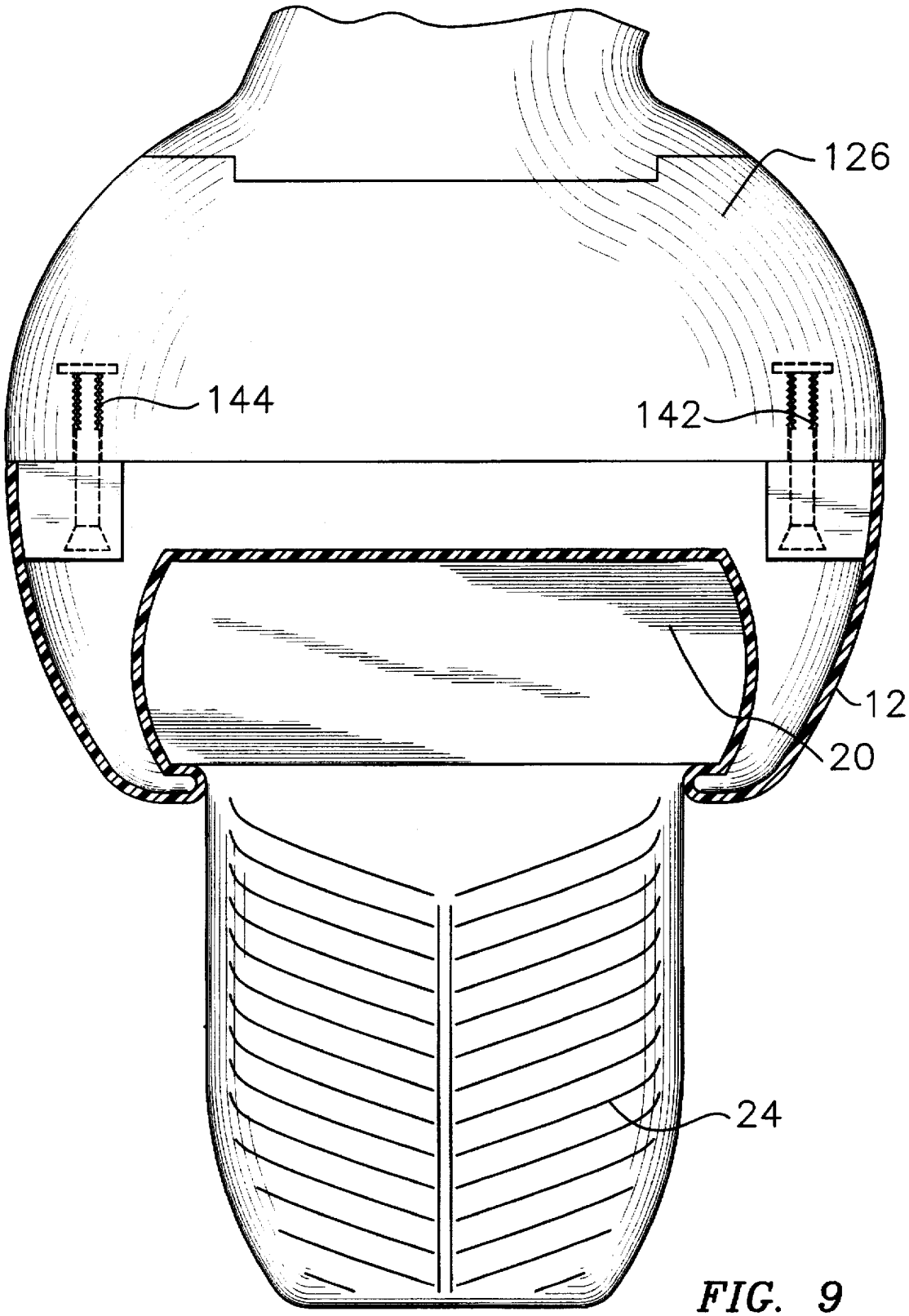
FIG. 9 is a front view showing the paddle, slide assembly and channel of the subject invention mounted to a pontoon.

FIG. 9 shows, in some detail, the interface between the slide assembly 12 and pontoon 126. Elongated bolts 142 and 144 secure the pontoon 126 to the slide assembly 12. From FIG. 9 it will be appreciated that the slide assembly 12 can be mounted to a variety of buoyant and non-buoyant structures, not just on pontoons. One example would be an attachment to a ski-like flat surface structure along side a vessel, such a canoe.

The apparatus described above proves the transfer of available energy by efficiently utilizing both the lower body and the upper body of the operator.

The apparatus may be propelled by the operator facing forward, i.e., towards the front of the apparatus by grouping handles 38 and 40 and pulling the handles towards him/her while at the same time placing his/her feet on the pedals 56 and 58 and pressing the pedals forwardly. This action will cause the cables 42 and 44 to be taken up on flywheels 34 and 36, and further, will cause cables 50 and 52 to be pulled forward, thereby causing the slide mechanisms 20 and 22 to be moved within channel 16 towards bumpers 28 which are in the rear of the boat. This action is referred to as the power stroke. The paddles 24 will be in the lowered position because of the weighted tip 96, as shown in FIG. 1B. Water pressure will build up on surfaces 94 of the paddles, thereby propelling the apparatus forward as the slide moves from the front to the rear of channel 16. When the slides 20 and 22 reach bumpers 28, the power stroke has been completed and springs 30 and 32 will cause the slides to move back to the forward initial position, as shown in FIG. 2. The force of the water on the convexed surface 92 of the paddles 24 will cause the paddles to rotate about pivot rod 88 and move to the raised position, as shown in FIG. 1A, with portions of the paddles entering cavities 72. This permits the slides 20 and 22 to move back to their initial position, as shown in FIG. 2, without substantial drag.

If the operator prefers to utilize the apparatus facing the rear 67 of the vessel, seat 61 is simply rotated 180°, handles 38 and 40 are reversed, and the operator places his/her feet on pedals 68 and 70. The rowing and foot action is repeated with the same results, however, cables 50 and 52 must be detached from to sliding block assemblies 60 and 62 and reattached to sliding block assemblies 64 and 66. In addition, the flywheel cables 50 and 52 must be repositioned to the top of the flywheels 34 and 36. It is also possible to utilize a similar apparatus with two persons facing each other and having dual rowing stations, however, that embodiment is not shown.

The apparatus described herein incorporates a more effective use of the operator's upper and lower body and an increase in paddle surface area to increase the forward thrust, because in the preferred embodiment, six separate paddles are utilized. The apparatus also provides a more efficient continuous return of the paddles so that repeat power strokes may be delivered and redelivered much faster than in conventional rowing and paddling apparatus.

The invention permits each paddle 24 to free float into the lowered position so that the paddles are always in the position for a power stroke to be applied, and then to pivot to the raised position after the power stroke has been completed. Each paddle is designed with a unique shaped enlarged head 91 and includes at least one guide rib 80 which is received in a slot 81 in the slide 20 for stabilizing the paddle 24. The enlarged head 91 of paddle 24 conforms with the inside cavity 72 of slide 20 to maximize holding surface when force is applied and to free float into the lowered position without any obstruction. Preferably, surface 94 of the paddle is concaved or cupped to provide increased efficiency. This cupped surface will grasp water during the power stroke to provide thrust efficiency, and the multiple paddles which are substantially evenly spaced along the slide will provide more direct energy to for vessel movement. The surface 92 of paddle 24 is convexed so as to reduce drag during return of the slide to the forward position.

It is preferred that the paddles 24 and the slide 20 are both below water line to provide water lubrication to the moving parts so that neither paddle 24 nor slide 20 will develop any appreciable friction while operating. The sizes of the paddle may be varied to better suit the physical abilities of the persons who will utilize the vessel, that is, a small child would use a small surface paddle with reduced thrust capacity but still experience forward movement, whereas, a strong adult could use larger paddles to develop a faster movement. Increased thrust in power could also increase carrying and towing capacity.

In addition, the vessel may be moved upstream, i.e., against the current with greater efficiency due to increased thrusting power and because the paddles 24 return very quickly to their ready forward position.

Figure 8:
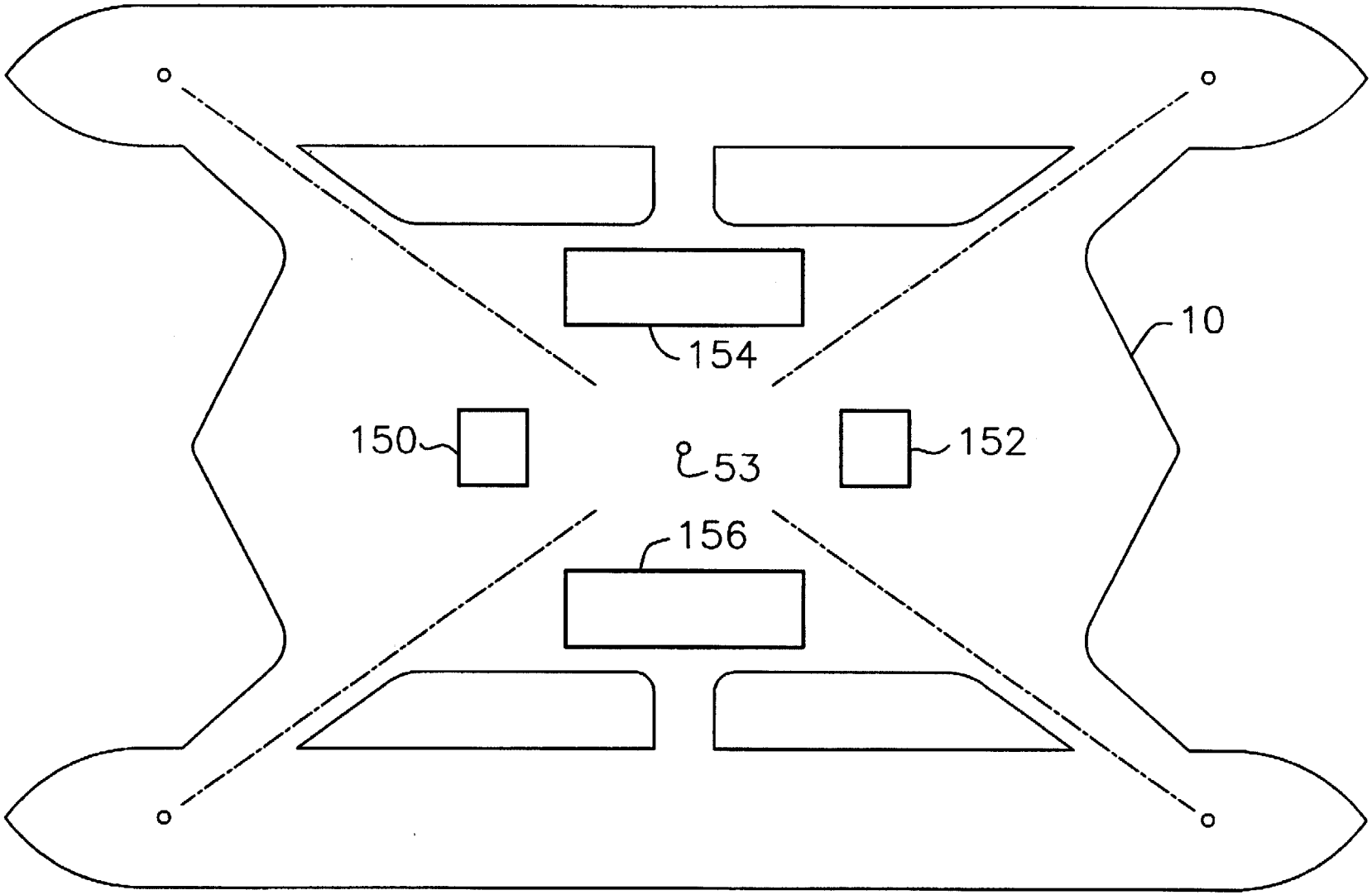
FIG. 8 is a center line drawing showing various assembly options.

The slide 20 can vary in shape, but preferably, is free floating and rectangular in shape with a rounded edge sliding bar. It can be made in other shapes, provided that enough thickness and width is provided for the cavities 72 for the paddle 24. The slide 20 and the guide 16 preferably fits below water line and the guide 16 should be approximately twice the length of the slide 20. The slide and the guide sizes provide for free floating movement when operational. In the preferred embodiment, the slide is three feet long and the guide is six feet long. Thus the slide assembly will travel only three feet in length, after which, the rowing power stroke is ended and the slide returns by spring action to the front of the guide. Constant pressure due to the springs described above are applied to the cables so that substantially no slack will develop during operation and, as a result, pressure can be applied from either direction of the rowing handle simply by removing the handles from the sockets and repositioning them into the other direction. The seat can swivel into the opposite direction and the foot pedals can be disconnected from the forward location to the rear location. The operator may face forward and apply rowing and/or a foot pedal power stroke or he/she can face to the rear and apply rowing and/or foot pedal power stroke. This is more readily accomplished because the apparatus is very well balanced in that the center of gravity is maintained due to the cross-frame design, as shown in FIG. 8, that is, the frame is highly symmetrical. This also allows for assembly in each direction. Thus in FIG. 8, boxes 150 and 152 designate alternate foot pedal assembly areas. Boxes 154 and 156 designate flywheel assembly areas.

Each side of the apparatus operates independently of the other side so that the apparatus may be readily turned, that is, the operator may apply force to handle 38 without applying force to handle 40 and/or can apply force to foot pedal 56 without applying force to foot pedal 58 so that the apparatus will turn to the right.

In the event that only the handles 38 and 40 are used, such as for example, for direction maneuvers, the slack in cables 50 and 52 is taken up by the springs 98 and 100.

There are four basic maneuvers where pressure and tension are to be maintained:

(1) Standing position—the slides 20 and 22 are in the forward position, as shown in FIG. 2. The springs 30 and 32 hold all cables taut.

(2) Rowing power stroke—as upper body force is applied to rowing handles 38 and 40, cables 42 and 44 are pulled onto flywheels 34 and 36, and approximately three feet of cables 42 and 44 are used. When lower body force is applied to foot pedals 56 and 58, the travel distance of the foot pedals is approximately two feet, and any additional cable slack will be taken up with the preset spring tension of springs 106 and 108 connected between the pedals 56 and the slide block assembly 60. At the end of the power stroke, the forward pontoon springs 30 and 32 will be 90% extended and under pressure to return the slides 20 and 22 to the starting position, as shown in FIG. 2. As upper and lower body forces relax, both handles 38 and 40 and foot pedals 56 and 58 will return to their starting positions.

(3) Release stroke—when the operator releases applied forces at any time during the power stroke, the handles 38 and 40 and foot pedals 56 and 58 return from pulling pressure by the springs 30 and 32.

(4) Maneuver stroke—course correction may be made with independent use of handle 38 or handle 40 or foot pedal 56 or foot pedal 58. For maximum turning force, both the handle and foot pedal on one side of the apparatus should be used simultaneously. If only the handle is used, the three feet of foot pedal cable 50 or 52 will be taken up by the sliding block assembly.

As best illustrated in FIG. 8, the symmetrical center point of the frame 10 is approximately the center of balance. The pontoons 39 and 41, shown in FIG. 6, are connected to frame 10 by members 43, 45, 47, 49 and 51. Members 43, 47, 49 and 51 criss-cross through the center of balance 53. This provides for assembly of the power paddle slide assembly from either end. Thus the foot pedal, spring assemblies may also be used in either direction. This allows for constant center of balance for the operator, as well as allowing pontoons to float in a balance position. Balanced pontoons are required for proper forward and directional movement.

Substantially any craft can be mounted to be insure that proper balance is maintained, such as those crafts shown in FIGS. 13B, 13C and 13D.

The apparatus of this invention offers increased safety, including when used with other crafts.

One may paddle upstream more efficiently, and the apparatus may be used as exercise equipment in a home pool or taken out for a quiet ride around a lake or pond.

The invention may be embodied in other forms or carried out in other ways without departing from the true spirit and essential characteristics thereof. For example, other materials and geometries may be used. The present embodiment is therefore to be considered in all respects illustrative and not restrictive, the scope of the invention being indicated by the appended claims, and all changes and other embodiments which come within the meaning and range of equivalencies are intended to be embraced therein.

I claim:

1. An apparatus for propelling a water vehicle comprising:

a slidable slide mechanism;

at least one paddle attached to said slidable slide mechanism;

a channel; said slide mechanism slidable within said channel; said paddle being rotatable whereby said paddle is lowered when said slide mechanism moves in one direction and is raised when said slide mechanism moves in the opposite direction;

a frame; a seat and at least one foot pedal located on said frame; said foot pedal located adjacent to said seat; said foot pedal being movable; said seat mounted on said frame; said foot pedal connected to said slide mechanism whereby the movement of said foot pedal will move said slide mechanism;

a tension mechanism; said tension mechanism connected to said foot pedal for biasing said foot pedal in one direction.

2. An apparatus for propelling a water vehicle comprising:

a slidable slide mechanism;

at least one paddle attached to said slidable slide mechanism;

a channel; said slide mechanism slidable within said channel; said paddle being rotatable whereby said paddle is lowered when said slide mechanism moves in one direction and is raised when said slide mechanism moves in the opposite direction;

a pair of slide mechanisms and a pair of channels; said channels generally oriented in the same direction; a plurality of paddles attached to each of said slide mechanisms.

3. A water vehicle comprising:

a floatation assembly;

a propulsion apparatus attached to said floatation assembly; said propulsion apparatus including a slidable slide mechanism;

at least one paddle attached to said slidable slide mechanism;

a channel; said slide mechanism slidable within said channel; said paddle being rotatable whereby said paddle is lowered when said slide mechanism moves in one direction and is raised when said slide mechanism moves in the opposite direction;

a frame; a seat and at least one foot pedal located on said frame; said foot pedal located adjacent to said seat; said foot pedal being movable; said seat mounted on said frame; said foot pedal connected to said slide mechanism whereby the movement of said foot pedal will move said slide mechanism;

a tension mechanism; said tension mechanism connected to said foot pedal for biasing said foot pedal in one direction.

4. A water vehicle comprising:

a floatation assembly;

a propulsion apparatus attached to said floatation assembly; said propulsion apparatus including a slidable slide mechanism;

at least one paddle attached to said slidable slide mechanism;

a channel; said slide mechanism slidable within said channel; said paddle being rotatable whereby said paddle is lowered when said slide mechanism moves in one direction and is raised when said slide mechanism moves in the opposite direction;

a pair of slide mechanisms and a pair of channels; said channels generally oriented in the same direction; a plurality of paddles attached to each of said slide mechanisms.

* * * * *